US009637887B2

(12) United States Patent
Wighton

(10) Patent No.: US 9,637,887 B2
(45) Date of Patent: May 2, 2017

(54) RECLAIMER 3D VOLUME RATE CONTROLLER

(71) Applicant: 3D Image Automation Pty Ltd, Joondalup, Western Australia (AU)

(72) Inventor: Paul John Wighton, Joondalup (AU)

(73) Assignee: 3D Image Automation Pty Ltd, Joondalup (AU)

( * ) Notice: Subject to any disclaimer, the term of this patent is extended or adjusted under 35 U.S.C. 154(b) by 72 days.

(21) Appl. No.: 14/428,241

(22) PCT Filed: Sep. 13, 2013

(86) PCT No.: PCT/AU2013/001049
§ 371 (c)(1),
(2) Date: Mar. 13, 2015

(87) PCT Pub. No.: WO2014/040137
PCT Pub. Date: Mar. 20, 2014

(65) Prior Publication Data

US 2015/0247301 A1 Sep. 3, 2015

(30) Foreign Application Priority Data

Sep. 14, 2012 (AU) ..... 2012904024

(51) Int. Cl.
*G06F 7/70* (2006.01)
*G06F 19/00* (2011.01)
(Continued)

(52) U.S. Cl.
CPC ..... *E02F 3/26* (2013.01); *E02F 3/18* (2013.01); *E02F 3/46* (2013.01); *E02F 9/262* (2013.01); *E02F 9/265* (2013.01)

(58) Field of Classification Search
CPC ..... E02F 3/18; E02F 3/46; E02F 9/262; E02F 9/265; E02F 3/26; E02F 9/261; E02F 9/264
(Continued)

(56) References Cited

U.S. PATENT DOCUMENTS 5,860,232 A * 1/1999 Nathenson ..... E02F 3/92 15/300.1
5,996,702 A * 12/1999 Hall ..... E02F 9/26 172/4.5
(Continued)

FOREIGN PATENT DOCUMENTS

AU 780449 2/2002
CN 101338573 A 1/2009
(Continued)

OTHER PUBLICATIONS

Office Action issued for Chinese patent application No. 201380059292.X, dated Apr. 28, 2016, 11 pages, including English translation.
(Continued)

*Primary Examiner* — Harry Oh
(74) *Attorney, Agent, or Firm* — Hamre, Schumann, Mueller & Larson, P.C.

(57) ABSTRACT

A 3D volume rate control method and apparatus (10) for a slewing bucket-wheel stockpile reclaimer 16 is described. The apparatus (10) comprises four 3D image sensors (12) mounted adjacent a bucket-wheel (14) of the (reclaimer 16), which are adapted to provide 3D images of a stockpile bench face. The apparatus includes a data processor (20) for: (i) processing the 3D images produced by the 3D image sensors (12) to generate a 3D stockpile bench face profile, (ii) calculating a reclaim cut volume rate at which material is being cut from the stockpile face based on a measured change in volume of the 3D stockpile bench face profile in
(Continued)

the area abutting the excavation tool, (iii) calculating a reclaim cut volume of material that will be cut from the stockpile face based on the shape of the excavation tool and the 3D stockpile bench face profile to determine a feed forward reclaim cut volume rate profile, and (iv) calculating an operating parameter for the reclaimer based on a desired reclaim cut volume rate compared to the measured reclaim cut volume rate and the feed forward reclaim cut volume rate profile. The method and apparatus provide accurate reclaim volume measurement so that the reclaim volume rate becomes independent of the product characteristics, stockpile bench face shape and bucket-wheel cutting parameters.

23 Claims, 13 Drawing Sheets

(51) Int. Cl.

| | |
|---|---|
| ***G06G 7/00*** | (2006.01) |
| ***G06G 7/76*** | (2006.01) |
| ***E02F 3/26*** | (2006.01) |
| ***E02F 3/18*** | (2006.01) |
| ***E02F 3/46*** | (2006.01) |
| ***E02F 9/26*** | (2006.01) |

(58) Field of Classification Search
USPC ..... 701/50
See application file for complete search history.

(56) References Cited

U.S. PATENT DOCUMENTS 6,108,949 A * 8/2000 Singh ..... E02F 3/437 37/195
6,363,632 B1 * 4/2002 Stentz ..... E02F 3/437 37/348
6,369,376 B1 * 4/2002 Gerlach ..... E02F 9/26 250/223 R
8,345,926 B2 * 1/2013 Clark ..... E02F 9/26 358/505
8,872,643 B2 * 10/2014 Ebert ..... E02F 9/24 324/329
8,983,738 B2 * 3/2015 Avitzur ..... E02F 9/205 701/23
9,156,167 B2 * 10/2015 Cameron
2002/0028124 A1 * 3/2002 Taylor ..... B65G 3/02 414/133
2003/0000115 A1 * 1/2003 Green ..... E02F 3/435 37/348
2004/0088138 A1 * 5/2004 Mann ..... E02F 3/26 702/175
2005/0246133 A9 11/2005 Mann
2010/0245542 A1 * 9/2010 Kim ..... G01B 11/00 348/46
2013/0311031 A1 * 11/2013 Friend ..... G05D 1/0278 701/26
2014/0231215 A1 * 8/2014 Lowery ..... E02F 7/026 198/317
2015/0354169 A1 * 12/2015 Wei ..... E02F 9/205 701/50

FOREIGN PATENT DOCUMENTS

CN 102131986 A 7/2011
EP 1278918 1/2003

OTHER PUBLICATIONS

Changwoon Jee, "Automation of Coke Reclaiming with 3D Stock Pile Imaging System", Proceedings of the 2002 IEEE International Symposium on Industrial Electronics, 2002, vol. 1, pp. 228-232 and can be found at http:/ieeexplore.ieee.org/application/enterprise/entconfirmation.jsp?arnumber=1026070&icp=false&tag=1.
Lu et al., "A 3DOF System for 3 Dimensional Stockpile Surface Scanning using Laser", 6th IEEE Conference on Industrial Electronics and Applications, 2011, 5 pages and can be found at http://ieeexplore.ieee.org/xpl/articleDetails.jsp?tp=&arnumber=5975540&queryText%3DA+3DA+3DOF+system+for+3+dimensional.
Choi et al., "Automatic Landing Method of a Reclaimer on the Stockpile", IEEE Transactions on Systems, Man, and Cybernetics—Part C: Applications and Reviews, vol. 29, No. 1, pp. 308-314, Feb. 1999.
International Search Report and Written Opinion, issued in the corresponding International PCT application No. PCT/AU2013/001049, mailed Nov. 11, 2013, 8 pages.
Corrected Written Opinion, issued in the corresponding International PCT application No. PCT/AU2013/001049, mailed Nov. 24, 2014, 4 pages.

* cited by examiner

RECLAIMER 3D VOLUME RATE CONTROLLER

FIELD OF THE INVENTION

The present invention relates to a three-dimensional (3D) volume rate control method and apparatus for controlling the reclaim rate of a stockpile reclaimer and relates particularly, though not exclusively, to such a method and apparatus applied to a slewing bucket-wheel reclaimer.

BACKGROUND TO THE INVENTION

Slewing bucket-wheel reclaimers are the most common type of reclaimers used in the iron ore and coal industries. Another common type of reclaimer is the bridge reclaimer.

Bucket-wheel reclaimers are a high cost mining asset. Individual machine cost may exceed $30 M, with supporting stockyard infrastructure adding significant cost. Relatively small improvement in reclaimer productivity will provide a significant economic benefit to the business. As an example of the economic benefit that can be achieved is given below:

Ship load time is 20 hours for 200 kt at 10,000 tph.

A 2.5% reclaim rate improvement (10,000 tph to 10,250 tph) reduces ship load time by approximately 30 minutes.

Based on 300 machine production days per annum this equates to a 150 hour reduction in machine operating time.

Sustained rate improvement would provide >5,000 t per day increased machine production.

Based on 300 days machine utilisation per annum, this equates to a production opportunity of more than 1.5 Mt per annum.

Slewing bucket-wheel reclaimers operate in the following manner. The stockpile is reclaimed in a series of 'Benches' where each bench defines a layer of the stockpile, as illustrated in FIG. 2. The height of each layer depends on the bucket-wheel size, with a typical bench height being equal to the bucket-wheel radius (5.0 meters) and a maximum bench height being 0.65 of the diameter (6.5 meters). The reclaimer starts at the top bench of a previously stacked stockpile and reclaims the bench in a series of radial cuts by slewing (swinging) the bucket-wheel across the face of the stockpile, as shown in FIG. 2.

At the end of each face cut, the reclaimer travels forward (Step Advance) a short distance (typically 1.0 m for a 5.0 m bucket-wheel), and then begins the next cut. The rate of reclaiming is controlled during the face cut by adjusting the speed of the slew motion. The general formula for reclaim rate when digging a full height bench face, in cubic meters per second, at any point along the face cut is:

Face Height (meters)×Face Cut Depth (meters)×Radial Slew Speed (meters per second).

Where: Face Cut Depth=Cosine (Slew Angle)×Step Advance Distance

The actual rate will depend on the shape of the stockpile at the bucket-wheel face.

The overwhelming majority of bucket-wheel reclaimers are fitted with power-based reclaim rate controllers. Power-based reclaim rate controllers derive an implied reclaim rate based on the digging power of the bucket-wheel.

Reclaiming is undertaken in order to move product from a stockpile to a destination, be it a train, ship or another stockpile via a transport system.

In general terms, minimum cost to move the product is achieved by transporting the product at the maximum rate supported by the transport equipment. The maximum rate supported by transport equipment is determined by the maximum volume rate. For example:

1. The maximum transport rate for a belt conveyor is usually limited by the volume that can be handled without spillage over the edges of the belt.
2. The maximum transport rate for a transfer chute is limited by the volume that can pass through the chute without blockage.

Although volume is normally the limiting factor, current reclaim rate controllers use an implied reclaim weight rate controller (controls in tonnes per hour). One of the disadvantages of prior art reclaim rate controllers is the inability to control the reclaim rate in terms of volume. This results from the inability to measure the volume rate at the bucket-wheel. Inability to control the volume rate means that they cannot achieve the maximum transport volume rate.

Whilst volume is generally the limiting factor for transport equipment, there are cases where weight is also a limiting factor. For example, a conveyor trestle may have a weight limitation that overrides the volume limitation of the belt conveyor itself. In these cases, maximum transport efficiency is achieved by maintaining a consistent transport rate. Current reclaim rate controllers have poor performance in terms of rate fluctuation. This is due to their inability to accurately measure the reclaim rate based on implied measurement techniques. This is further explained in the following section.

In the case where there is a requirement to reclaim at a low rate, the inaccurate rate measurement of existing rate controllers results in incorrect rate and high rate fluctuations. Power based rate controllers are unable to determine the stockpile edges at low reclaim rates and often require operator intervention to set fixed reclaim slew range limits.

Due to the low cut depth at the outer slew region of a stockpile face cut, it is advantageous to finish the cut early for several cuts before cleaning up the ridge with a single longer cut. This practice is known a 'Waltz Step' of 'Clean-Up Pass'. However 'Waltz Step' reclaiming is rarely used with power based rate controllers, due primarily to their inability to adequately control the rate during the step changes in cut depth between the current face and the outer ridge.

Current reclaim rate control systems use implied methods to measure the reclaim rate, including digging energy (bucket-wheel current) or digging force (bucket-wheel torque). The achieved reclaim rate depends on the bucket-wheel digging efficiency (cubic meters per unit of energy/force) which is affected by a range of parameters including:

Product Type (particularly the granule size)

Product Mineral Composition (mine and section of ore body)

Product Density (variation of source product)

Moisture Content (from rain or dust suppression sprays)

Secondary Processing (combinations of crushing, screening and blending)

Bucket-wheel Cutting Efficiency for Different Products

Bucket-wheel Cutting Efficiency for Clockwise vs. Counter Clockwise

Bucket-wheel Cutting Efficiency due to wear

Product Compaction (time since stacked)

Stacking Pattern

No Load Current/Torque Drift

Non Linear Load to Rate Relationship

As the state of the stockpile is unknown, it is not possible to provide compensation for these factors. This results in less than optimal reclaim rates. Efforts to improve reclaimer productivity are limited by the reclaim rate measurement error.

Various systems attempt to improve the accuracy of the implied reclaim rate by use of single point or 2D radar sensors. These systems may collectively be referred to as 'predictive rate controllers'. Predictive rate controllers use 2D radar scanners to predict the approximate volume that will be reclaimed by the bucket-wheel. Predictive volume based systems perform a vertically orientated 2D scan of the stockpile face, with the third dimension being provided by the slew motion. The 2D scanner is located at a position ahead of the bucket-wheel.

An example of a prior art predictive rate controller utilising a 2D radar scanner is the system marketed by Indurad (Germany) as a 'Bucket-wheel Excavator Predictive Cutting Control'. The control is described to provide customer benefits of 'Predictive volume flow information and operator assistance'.

The radar scanners used in existing predictive systems are based on 77 GHz vehicle collision avoidance radar units. The combination of field of view (FOV) angle resolution (typically 4 degrees) and target distance accuracy (typically +−150 mm) results in inability to measure the stockpile face volume, particularly when the bucket-wheel cut depth is less than one meters (1.0 m).

During reclaiming operations, the stockpile area around the bucket-wheel will collapse and flow as product is removed. Accurate measurement of the reclaim rate requires that the volume in the area abutting the bucket-wheel be continuously measured. The 2D nature of the predictive volume scanning system means that the actual volume being reclaimed by the bucket-wheel cannot be measured. Instead, the reclaim volume is predicted. Collapsing and dynamic movement of the stockpile due to flow of product is not measured.

Predictive volume systems are typically used for operator assistance on manually operated reclaimers or as the theoretical (feed forward) speed of an implied (current/torque) reclaim rate controller. Whilst predictive volume systems improve the performance of an implied rate controller, the control performance is still affected by the same factors as the standard implied rate controller.

Prior art use of 3D laser scanning for stackers and reclaimers is described in European patent EP1278918, also published as US 2005/0246133. This prior art document is referred to hereinafter as P2.

The system described in P2 scans the stockpile to determine the stockpile shape for the purpose of controlling the movement of the reclaimer to the facing up position and to determine the slewing range of the bucket-wheel during reclaiming.

One of the problems that P2 seeks to overcome is the inaccuracies in the stockpile model that occur when using a 2D scanner where the stockpile shape is initially determined by way of a measurement pass of the bucket-wheel device and the 2D scanner, and then after the removal or stacking process is initiated the controller calculates a provisional stockpile model.

However this 2D system cannot detect changes of the stockpile shape which occur during the operation of the bucket-wheel device, for example, due to rainfall and the natural downslide processes or the like, as well as slides or downslides triggered by the removal process itself. P2 overcomes these problems by scanning the stockpile using a 3D laser scanner to determine the actual stockpile shape independently of the operation of the bucket-wheel device. The system described in P2 includes GPS receivers to provide accurate position information for the bucket-wheel reclaimer and/or the bucket-wheel itself. A claimed benefit of the system described in P2 is that the stockpile shape may be captured without carrying out a measurement pass and that bumping into the stockpile is avoided.

The system described in P2 is not able to measure the reclaimed volume at the bucket-wheel as the area abutting the bucket-wheel is not scanned. Furthermore there is no disclosure or suggestion in P2 of calculating a reclaim volume of material that will be cut from the stockpile face, based on the shape of the excavation tool and the 3D stockpile shape, to determine a cut reclaim volume rate. In fact there is no reference whatsoever in P2 to either volume measurement or reclaim rate control. The described control function is to position the bucket-wheel device in dependence on the measured stockpile shape, in order to optimise initial face-up positioning of the bucket-wheel and to control the bucket-wheel swing range based on the shape of the stockpile.

A commercial implementation of P2 was developed by iSAM AG (Germany) and is marketed by FL Smidt as the 'iSAM Automation System for Stacker Reclaimers.' The referred commercial implementation of P2 uses bucket-wheel power based implied reclaim rate control.

The present invention was developed with a view to providing a 3D volume rate controller method and apparatus which is less susceptible to the above-noted problems and disadvantages of the prior art implied reclaim rate controllers and predictive rate controllers.

References to prior art in this specification are provided for illustrative purposes only and are not to be taken as an admission that such prior art is part of the common general knowledge in Australia or elsewhere.

SUMMARY OF THE INVENTION

According to one aspect of the present invention there is provided a three dimensional (3D) volume rate control apparatus for a stockpile reclaimer, the apparatus comprising:

a plurality of 3D image sensors mounted adjacent an excavation tool of the stockpile reclaimer and adapted to provide 3D images of a stockpile bench face; and, a data processor for:

processing the 3D images produced by the 3D image sensors to generate a 3D stockpile bench face profile, calculating a reclaim cut volume rate at which material is being cut from the stockpile bench face based on a measured change in volume of the 3D stockpile bench face profile in the area abutting the excavation tool, calculating a reclaim cut volume of material that will be cut from the stockpile bench face based on the shape of the excavation tool and the 3D stockpile bench face profile to determine a feed forward reclaim cut volume rate profile, and calculating an operating parameter for the stockpile reclaimer based on a desired reclaim cut volume rate compared to the measured reclaim cut volume rate and the feed forward reclaim cut volume rate profile.

Preferably respective 3D image sensors are mounted on each side and adjacent to the excavation tool to provide 3D images of a complete cutting arc of the excavation tool on the stockpile face. Preferably the 3D image sensors also provide 3D images extending along a swing arc of the complete cutting arc for a sufficient distance to cover areas of the stockpile bench face that may flow or collapse around the excavation tool.

Typically four 3D image sensors are provided, two on each side of the excavation tool respectively, in order to avoid image occlusion by an excavation drive and support structures. In one embodiment the 3D image sensors are 3D time-of-flight cameras which measure the distance to an object in front of the camera by analyzing the time for a light pulse to travel from an illumination source to the object and back.

Typically the stockpile reclaimer is a bucket-wheel reclaimer and the excavation tool is a bucket-wheel. In a preferred embodiment the bucket-wheel reclaimer is a slewing bucket-wheel reclaimer. Advantageously the four 3D cameras are located immediately adjacent to the bucket-wheel and orientated such that the complete cutting arc of the bucket-wheel is measured.

By providing accurate reclaim volume measurement the reclaim volume rate becomes independent of the product characteristics, stockpile face shape and bucket-wheel cutting characteristics.

Whilst measurement and calculation of the reclaim volume is complex, the application of the bucket-wheel speed control is simplified as there is no longer any requirement to apply the customised correction parameters that are typically required to improve performance of power based controllers.

The measured stockpile face shape is also used to provide improved machine safety and bucket-wheel position control that operate in unison with the 3D volume rate controller to provide reclaimer performance improvements.

According to another aspect of the present invention there is provided a method of three dimensional (3D) volume rate control for a stockpile reclaimer, the method comprising the steps of:

obtaining 3D images of a stockpile face;

processing the 3D images to generate a 3D stockpile bench face profile;

calculating a reclaim cut volume rate based on a measured change in volume of the 3D stockpile bench face profile in the area abutting an excavation tool of the stockpile reclaimer;

calculating a reclaim cut volume of material that will be cut from the stockpile bench face based on the shape of the excavation tool and the 3D stockpile bench face profile to determine a feed forward cut volume rate profile; and, calculating an operating parameter for the reclaimer based on a desired reclaim cut volume rate compared to the measured reclaim cut volume rate and the feed forward reclaim cut volume rate profile.

Preferably the step of calculating the reclaim cut volume of material is performed by producing an excavation tool cut height map, which is a two dimensional array of distance values measured from a reference on the excavation tool to an edge of the excavation tool where it cuts into the stockpile bench face.

Typically the stockpile reclaimer is a bucket-wheel reclaimer, the excavation tool is a bucket-wheel, and the excavation tool cut height map is a bucket-wheel cut height map. In a preferred embodiment the bucket-wheel reclaimer is a slewing bucket-wheel reclaimer.

Typically the reference on the excavation tool is an arc formed by a point at the center of the bucket-wheel as it is slewed outwards across the stockpile bench face, this arc being referred to as "the bench arc". The distance values are preferably defined as the distance (in meters) from the bench arc and are measured along a series of cut arc rays running perpendicular to a bucket-wheel axle. The series of rays typically extend from a ray pointing vertically down to a ray pointing forward to the center face of the bucket-wheel. Advantageously the angular separation between the rays is chosen to match the camera target point size at a face of the bucket-wheel.

Typically the step of calculating a reclaim cut volume rate involves a step of calculating a reclaim cut volume of material at the stockpile bench face. Preferably the step of calculating the volume of material at the stockpile bench face is performed by calculating the sum of the volumes for each point of the 3D stockpile bench face profile in the area abutting the bucket-wheel.

Preferably the reclaim volume rate is calculated by comparing the stockpile bench face volume at two points in time as the bucket-wheel cuts the stockpile bench face.

Preferably a profile map is created to store the 3D stockpile bench face profile, with each profile point defined in terms of the distance from the bench arc along a cut arc ray.

Preferably a bucket-wheel face height map is calculated from the 3D stockpile bench face profile, with each point representing the distance from the bench arc.

Preferably the bucket-wheel face height map is subsequently used to calculate a bucket-wheel cut volume per meter of bench arc length at intervals along a bench arc of the stockpile bench face based on a known cut radius of the bucket-wheel.

Preferably the reclaim volume rate and the bucket-wheel cut volume per meter of bench arc are used in conjunction with the desired reclaim volume rate to calculate the bucket-wheel slew speed at all points along the bench arc.

Preferably the calculated bucket-wheel slew speed is published to a reclaimer slew speed control system.

Throughout the specification, unless the context requires otherwise, the word "comprise" or variations such as "comprises" or "comprising", will be understood to imply the inclusion of a stated integer or group of integers but not the exclusion of any other integer or group of integers. Likewise the word "preferably" or variations such as "preferred", will be understood to imply that a stated integer or group of integers is desirable but not essential to the working of the invention.

BRIEF DESCRIPTION OF THE DRAWINGS

The nature of the invention will be better understood from the following detailed description of several specific embodiments of 3D volume rate control method and apparatus, given by way of example only, with reference to the accompanying drawings, in which.

DETAILED DESCRIPTION OF PREFERRED EMBODIMENTS

Figure 1:
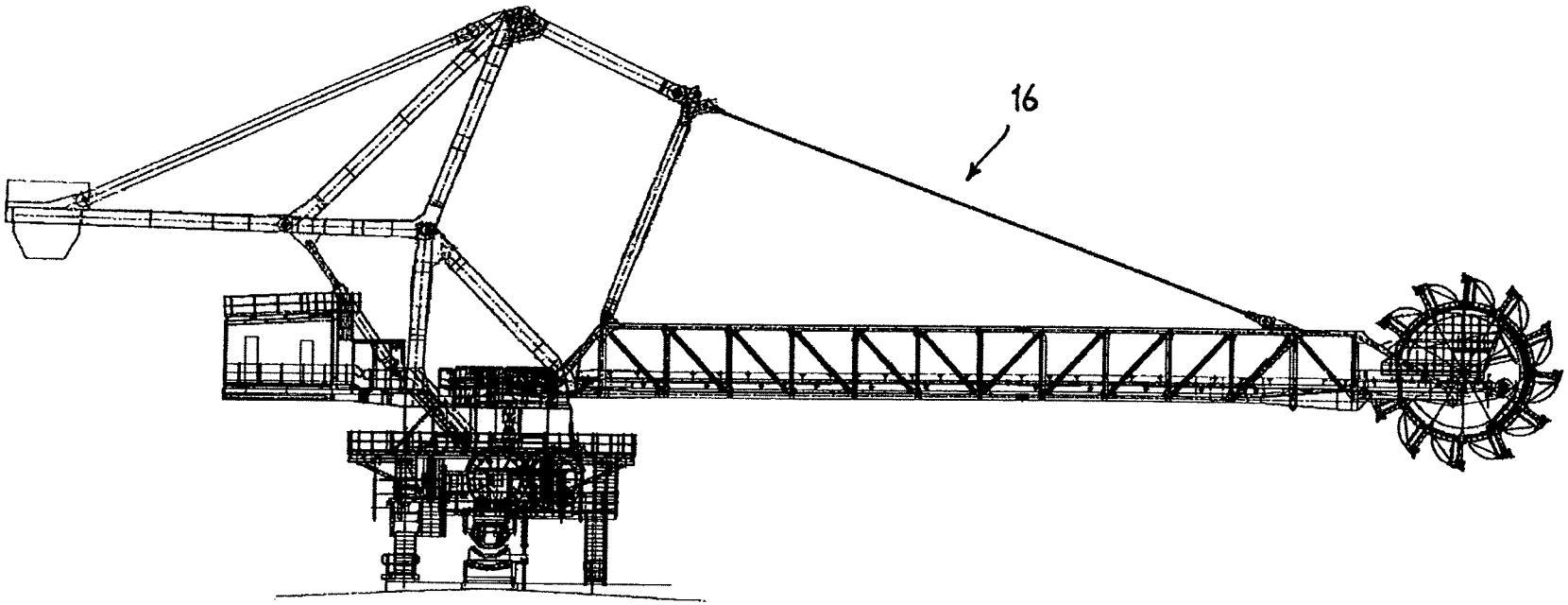
FIG. 1 illustrates a typical prior art slewing bucket-wheel reclaimer.
Figure 2:
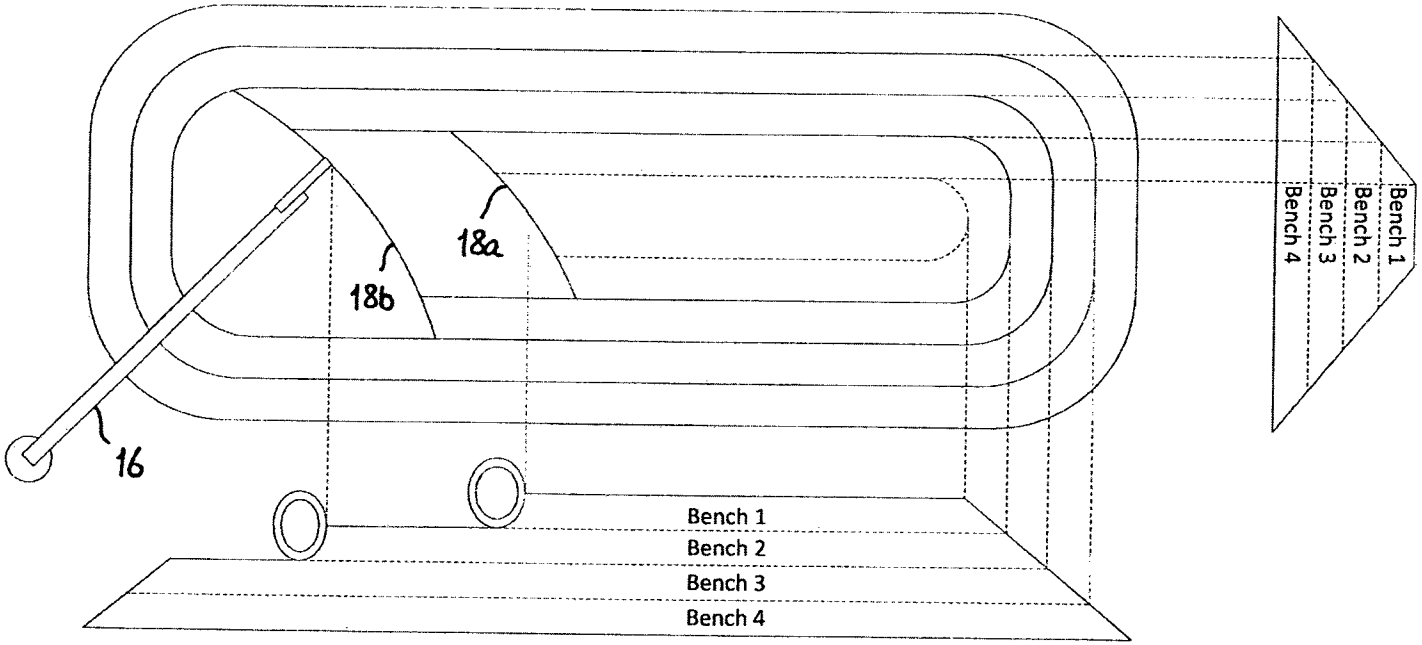
FIG. 2 illustrates a typical prior art arrangement of benches on a stockpile.
Figure 3:
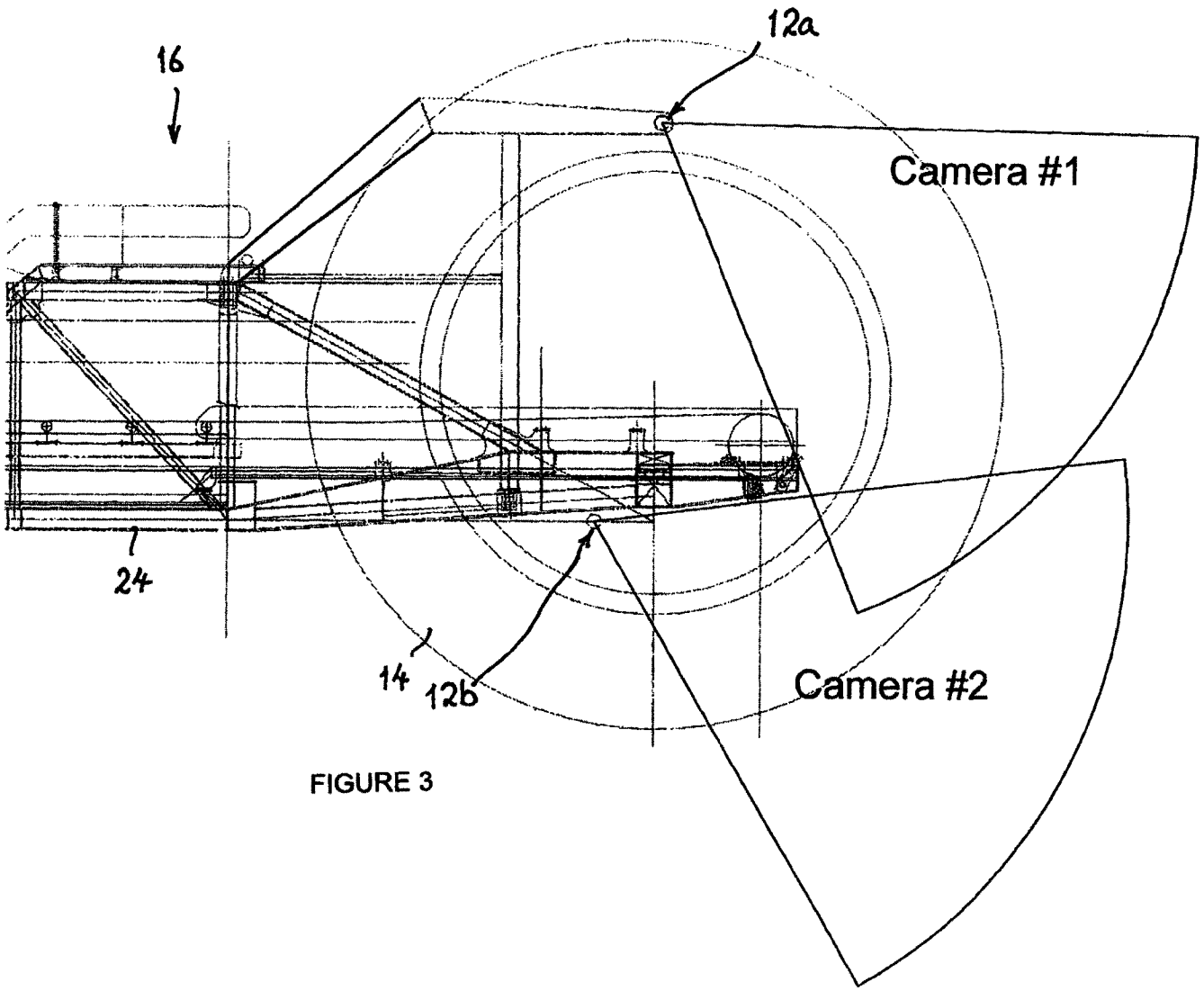
FIGS. 3 and 4 are a side view and plan view respectively illustrating the scan arc for each camera in a preferred embodiment of a 3D volume rate control apparatus according to the present invention.
Figure 4:
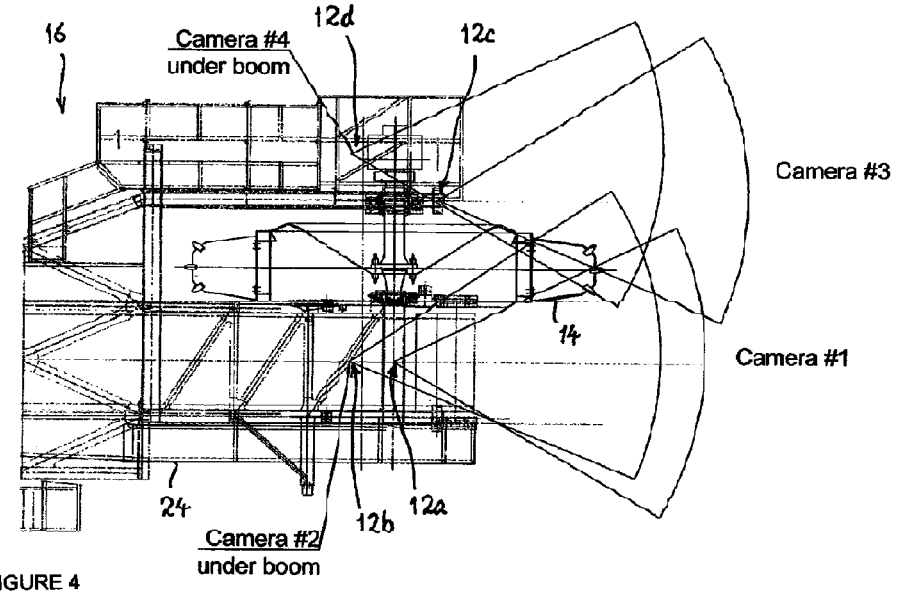
Figure 5:
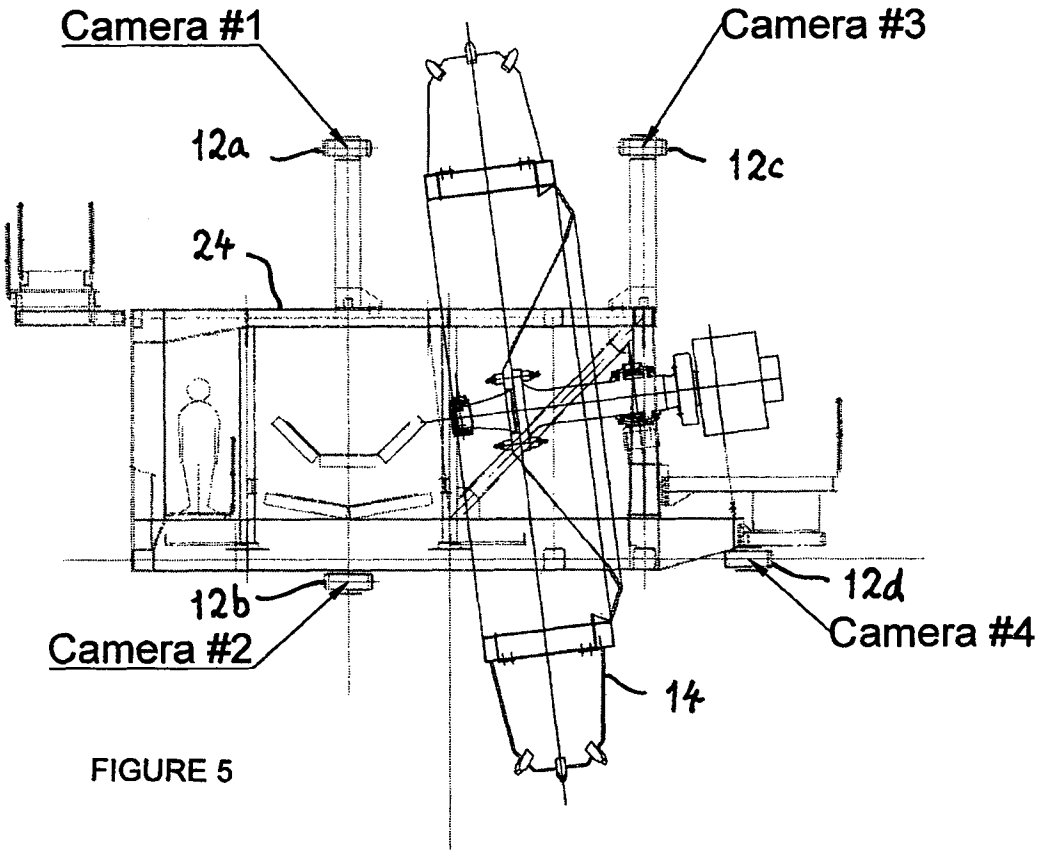
FIG. 5 illustrates the camera locations on each side of the bucket-wheel in the apparatus of FIG. 3.
Figure 6:
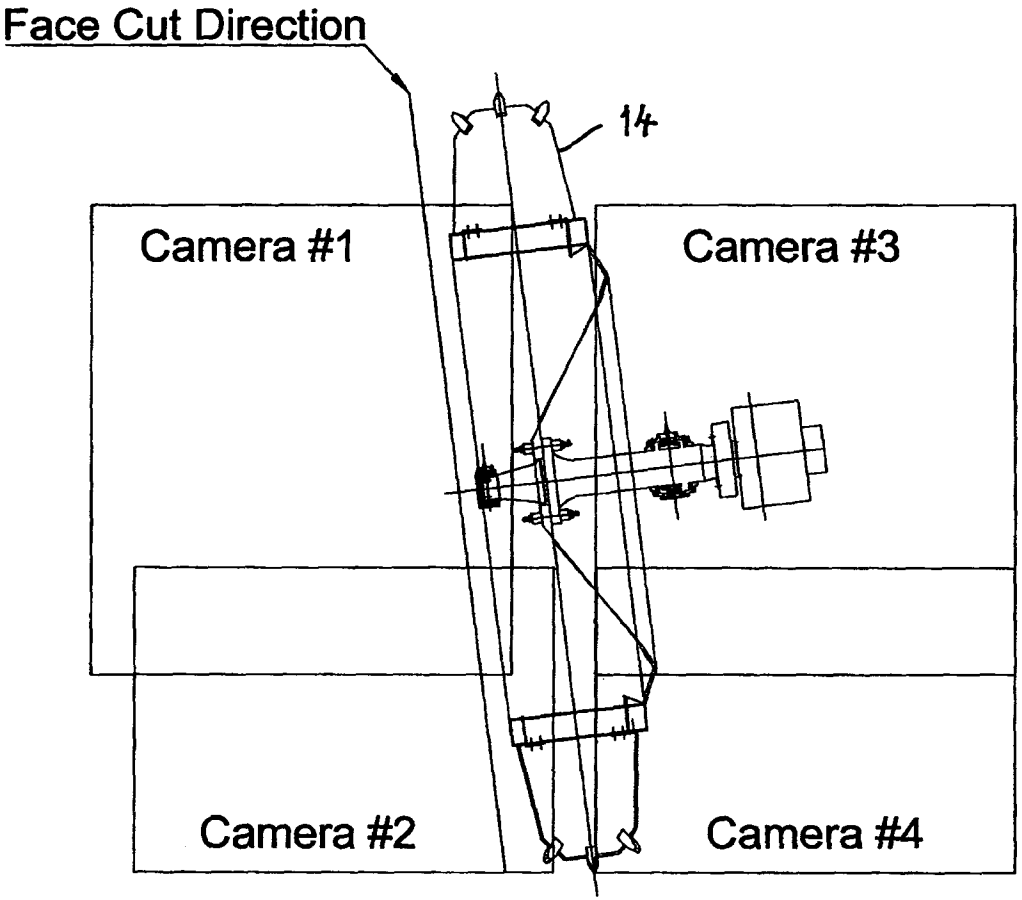
FIG. 6 illustrates the field of view of each camera at the bucket-wheel face in the apparatus of FIG. 3.

A preferred embodiment of the 3D volume rate control apparatus 10 in accordance with the invention, as illustrated in FIGS. 2 to 13, comprises a plurality of 3D image sensors 12 mounted adjacent to an excavation tool 14 of a stockpile reclaimer 16 and adapted to provide 3D images of a stockpile bench face 18 (see FIG. 2). Preferably respective 3D image sensors 12 are mounted on each side and to adjacent to the excavation tool 14 to provide 3D images of a complete cutting arc of the excavation tool on the stockpile bench face 18. Advantageously the 3D image sensors also provide 3D images extending along the swing arc for a sufficient distance to cover areas of the stockpile bench face 18 that may flow or collapse around the excavation tool. Typically the reclaimer is a bucket-wheel reclaimer 16 and the excavation tool is a bucket-wheel 14. In this embodiment the bucket-wheel reclaimer 16 is a slewing bucket-wheel reclaimer, of the type shown in FIGS. 1 and 2.

Typically four 3D image sensors 12 are provided, two on each side of the bucket-wheel 14 respectively. Advantageously the four 3D image sensors 12 are located immediately adjacent to the bucket-wheel 14 and orientated such that the complete cutting arc of the bucket-wheel 14 is measured, as shown in FIGS. 3 to 6. In this embodiment the 3D image sensors are 3D time-of-flight cameras 12 which measure the distance to an object in front of the camera by analysing the time for a light pulse to travel from an illumination source to the object and back.

The 3D volume rate control apparatus 10 further comprises a data processor 20 (see FIG. 13) for processing the 3D images produced by the 3D cameras 12 to generate a 3D stockpile face profile. The data processor 20 calculates a volume of material that is removed from the stockpile bench face 18 based on the change in the stockpile volume adjacent to the bucket-wheel to determine a reclaim cut volume rate. The data processor 20 then calculates one of more operating parameters for the bucket-wheel reclaimer 16, such as the bucket-wheel speed control, based on a desired reclaim volume rate compared to the measured reclaim cut volume rate. These operating parameters are sent to a reclaimer machine controller 22, for controlling both the travel speed and slew speed of the bucket-wheel 14.

The 3D volume rate control apparatus 10 provides improved reclaimer performance in comparison to existing 'State of the Art' Implied Rate systems. This improved performance is achieved by the accurate and dynamic measurement of the reclaimed volume using the change in volume around the bucket-wheel 14 to control the reclaim volume rate. Accurate reclaim volume measurement is achieved by capturing the changing volume of the area abutting each side of the bucket-wheel 14. The high speed 3D image sensors (cameras 12) are used to measure the volume which is being removed from the stockpile face area abutting the bucket-wheel 14.

The stockpile face area abutting the bucket-wheel 14 is subject to change in profile due to product flow, face collapses and product being thrown out of the buckets. The flow and collapse characteristics are unpredictable and product may also flow and the face collapse, even when the bucket-wheel is not slewing. By providing accurate reclaim volume measurement the reclaim volume rate becomes independent of the product characteristics, stockpile face shape and bucket-wheel cutting characteristics.

Whilst measurement and calculation of the reclaim volume is complex, the application of the bucket-wheel speed control is simplified as there is no longer any requirement to apply the customised correction parameters that are typically required to improve performance of power based controllers.

The measured stockpile face shape is also used to provide improved machine safety and bucket-wheel position control that operate in unison with the 3D volume rate controller to provide reclaimer performance improvements.

Figure 10:
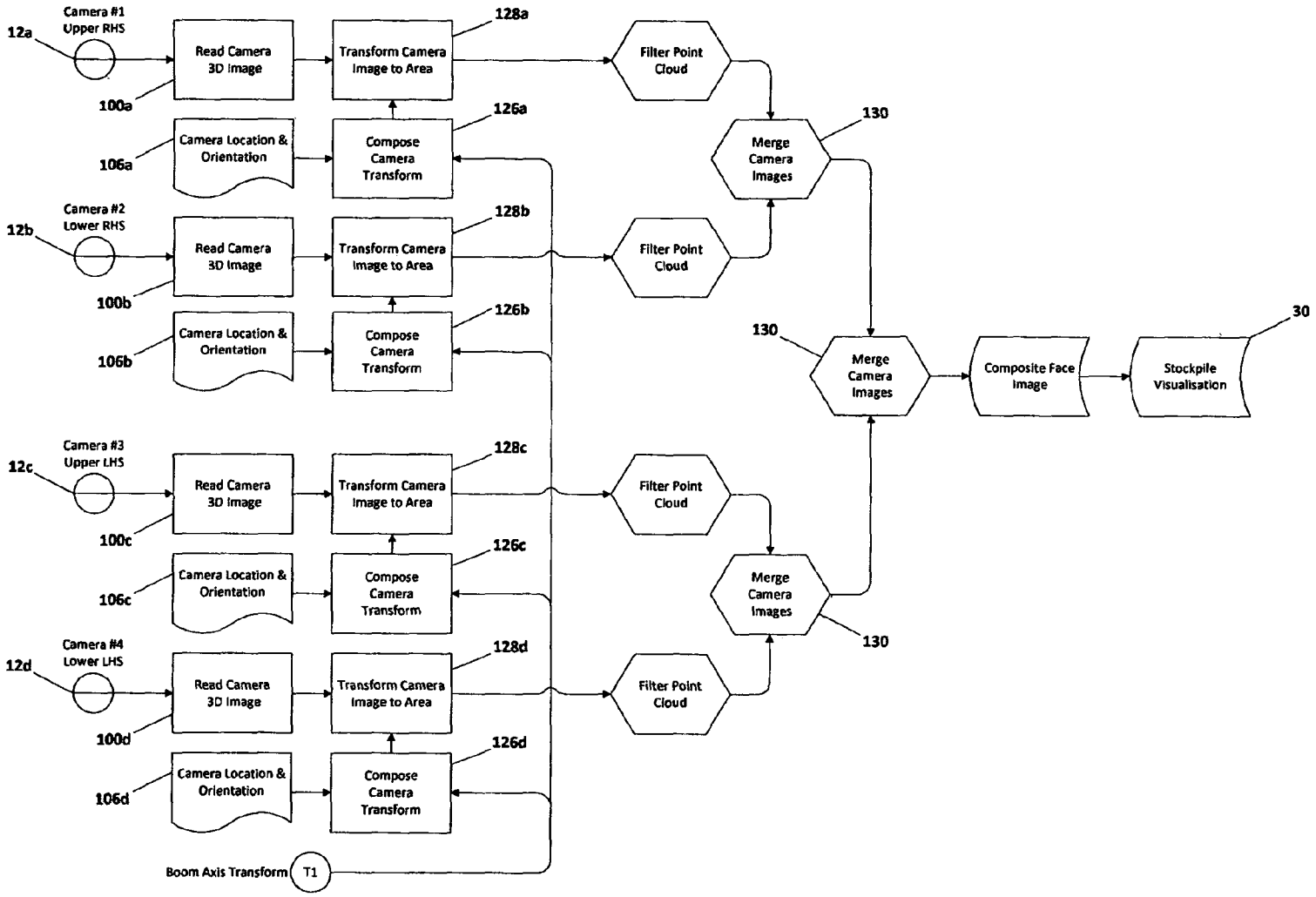
FIG. 10 is a process diagram showing the preferred steps for processing of 3D images in a preferred embodiment of the 3D volume rate control method according to the present invention.
Figure 11:
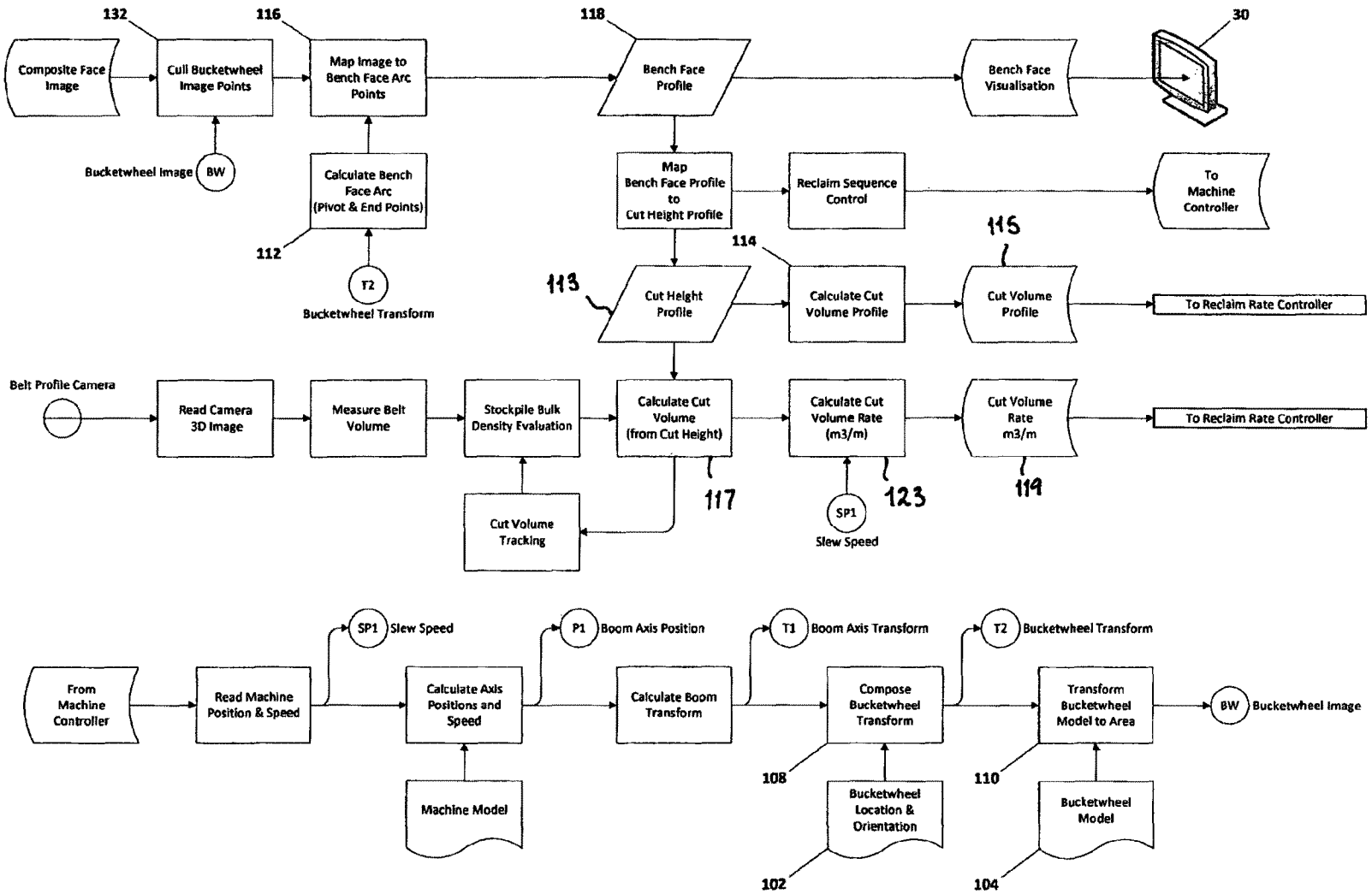
FIG. 11 is a process diagram showing the preferred steps for the processing of stockpile bench face images in a preferred embodiment of the 3D volume rate control method according to the invention.
Figure 12:
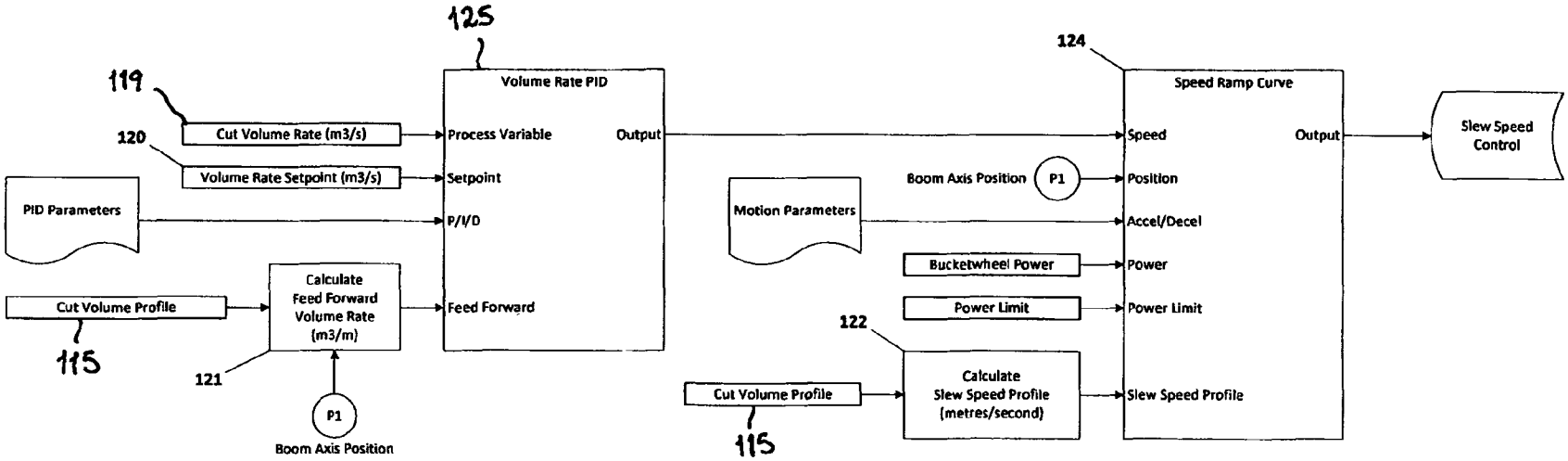
FIG. 12 is a process diagram showing the preferred steps for applying the measured reclaim volume rate to control a reclaimer in a preferred embodiment of the 3D volume rate control apparatus according to the present invention with rate limiting.
Figure 13:
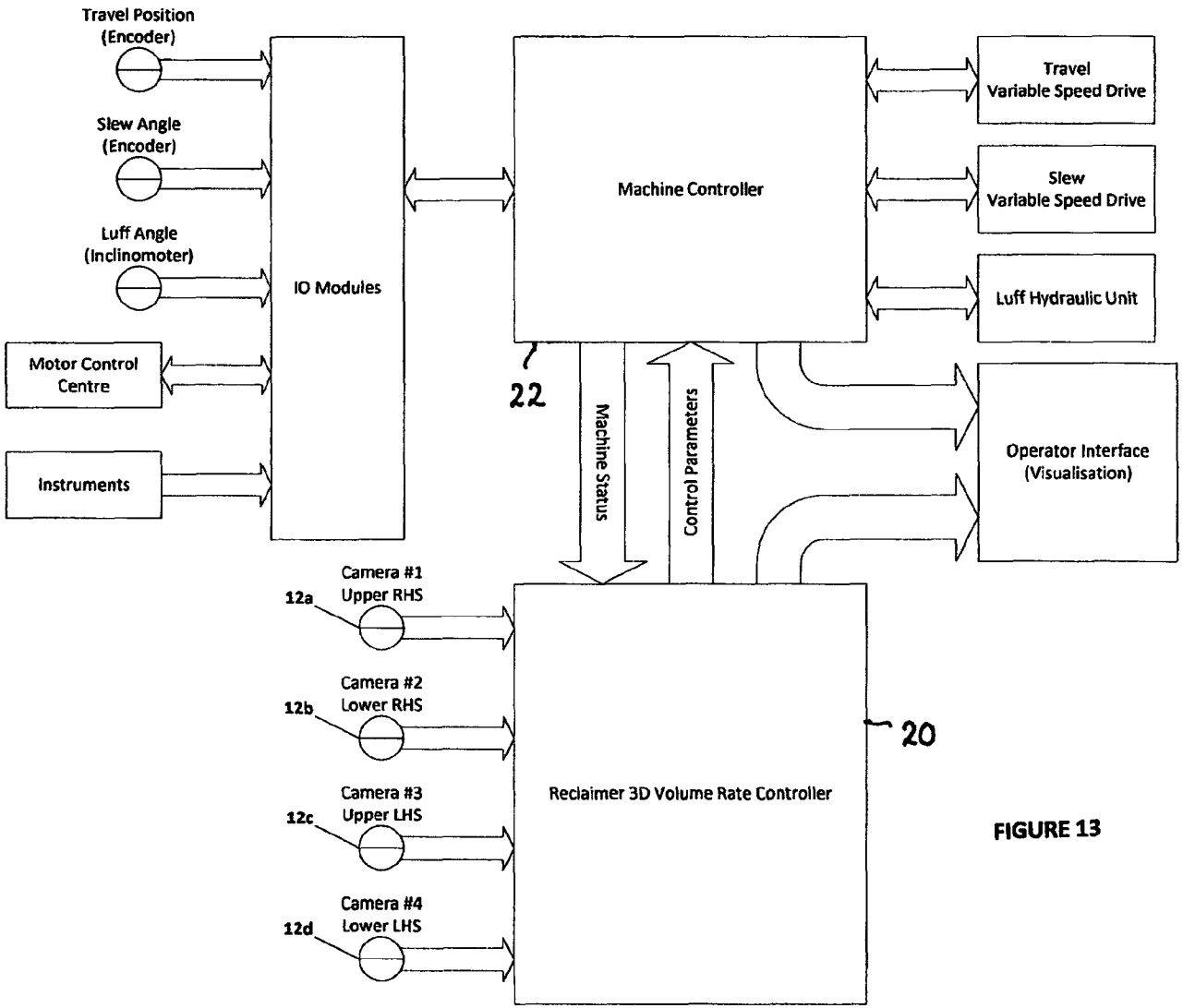
FIG. 13 is a block diagram showing the components of the 3D volume rate control apparatus 10 and machine controller; and, FIG. 14 illustrates a series of orientation rays extending from a bench arc to product a bench face height profile.

A preferred method of 3D volume rate control for a stockpile reclaimer 16, using the apparatus of FIG. 13, will now be described in detail with reference to FIGS. 3 to 12. The process illustrated in the flow chart of FIG. 10 is for four 3D cameras 12 (cameras 12*a*, 12*b*, 12*c* and 12*d*). The method may employ fewer 3D cameras, for example, in cases where the full cutting arc of the excavation tool is within the field of view. The 3D volume rate control method typically comprises the first step 100 in FIG. 10 of obtaining 3D images of a stockpile bench face. The method then comprises processing the 3D images to generate a 3D stockpile bench face profile, as will be described in more detail below.

The area in which stockpiles reside is called a stockyard. The stockyard area in which the reclaimer 16 is operating is defined as a horizontal plane extending for the full length and width of the stockyard and being parallel to the machine rails. The Stockyard North direction is defined as the direction of positive travel along the machine rails.

Figure 7:
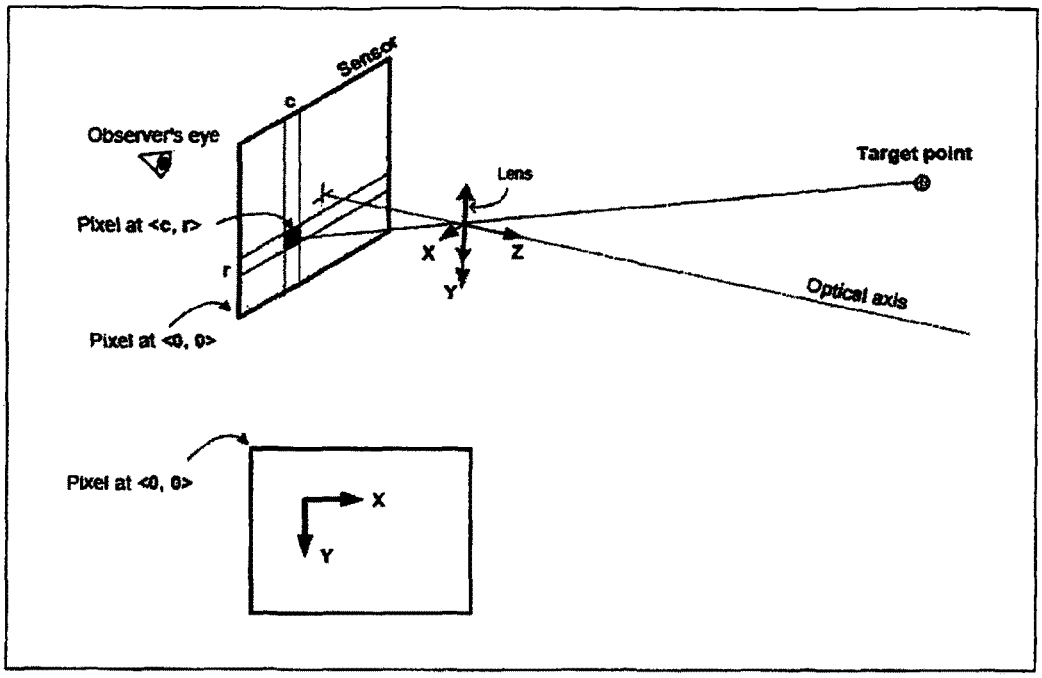
FIG. 7 illustrates the camera coordinates as employed in the apparatus of FIG. 3.
Figure 8:
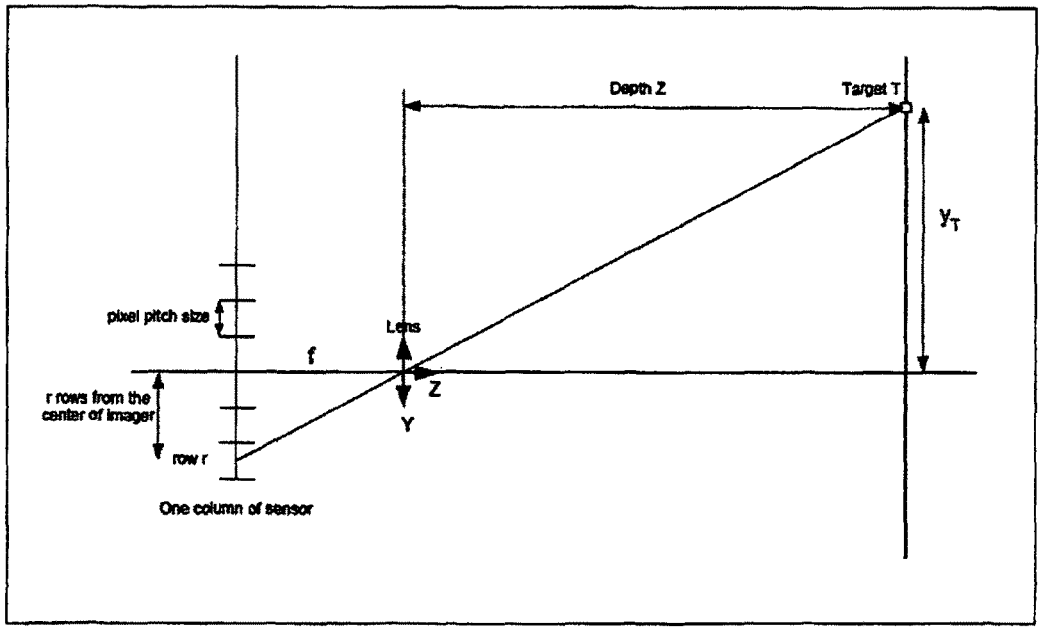
FIG. 8 illustrates the camera target coordinates as employed in the apparatus of FIG. 3.
Figure 9:
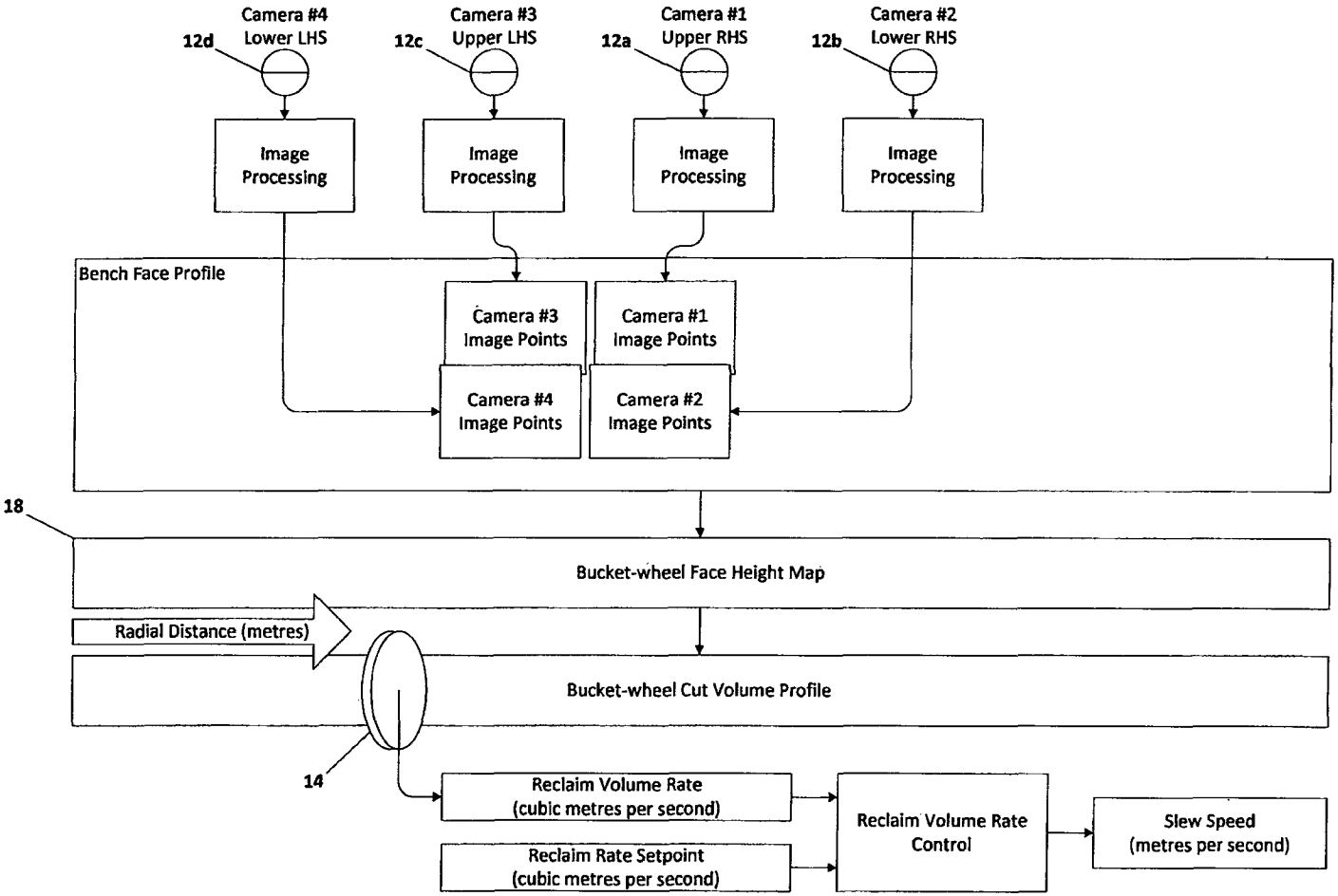
FIG. 9 is a schematic overview of the 3D volume rate controller apparatus and method according to the present invention.

The preferred 3D volume rate control method uses a local (right-hand) Cartesian coordinate system (x, y, and z, as shown in FIGS. 7 and 8) to define points in the 3D stockyard space with the axes defined as follows:

X Axis: a horizontal axis aligned with machine rails and in direction of Stockyard North Y Axis: a horizontal axis perpendicular to, and in an anti-clockwise (east to west) direction from, the positive x-axis (right-hand coordinate system)

Z Axis: a vertical axis perpendicular to the x- and y-axes

The component positions and orientations on the reclaimer 16 are defined with reference to the reclaimer local reference point and with all motions are their home positions. The reclaimer 16 local reference position is typically defined as the center of slew and at rail height. Forward kinematic methods are used to transform the component local coordinates to stockyard area co-ordinates, based on the current motion positions.

The reclaimer motion pivots and components (bucket-wheel 14 and cameras 12) are modelled, (step 104 in FIG. 11 and step 106 in FIG. 10) to provide the basis for calculation of component positions and orientation within a 3D space. The position and orientation of each camera with respect to the bucket-wheel 14 is fixed. The known position, orientation (in relation to the reclaimer local reference point), and dimensions of the bucket-wheel 14 are measured at step 102 (in FIG. 11), are transformed at step 108, to provide the parameters for the calculation of the bucket-wheel bench face arc at step 112 (in FIG. 11). The orientation of the bucket-wheel 14 includes parameters which describe any tilt and skew of the bucket-wheel.

In the case where the bucket-wheel 14 is not tilted or skewed, then the cut of the bucket-wheel is described as a torus with a circular cross section. Where the bucket-wheel 14 is tilted and/or skewed, then the cut of the bucket-wheel is a torus with an elliptical cross-section.

The method further comprises the step 114 (in FIG. 11) of calculating a cut volume profile of material that will be cut from the stockpile face based on the shape of a reclaimer excavation tool and the 3D stockpile face profile to determine a cut reclaim volume rate. The cut volume profile is calculated at incremental distances along an arc across the stockpile bench face by measuring the 3D stockpile bench face profile (using merged images from the 3D cameras 12) at step 116 and then evaluating which portion of the stockpile bench face profile will be cut by the bucket-wheel reclaim arc. The bench face profile is updated continuously at step 118. Updated images of the bench face can be viewed on monitor 30.

Accurate cut volume calculation is achieved, irrespective of the bucket-wheel tilt and/or skew, by calculating the volume along the direction of the bucket-wheel face cut. That is, the cut direction is along the line that runs around the tilted/skewed bucket-wheel 14.

Target position data supplied by each camera is mapped from the Camera Coordinates to Stockyard Area Coordinates. The 3D time of flight cameras 12 return a target distance for each pixel in the field of view (FOV), as shown in FIGS. 7 and 8. For a camera 12 with a pixel array size of 160 (h)×120 (v), there will be 19,200 target distance values returned in each frame. The angular resolution depends on the camera FOV. For a FOV of 40° (h)×30° (v), the angular resolution will be 0.25°. The position of the target point for each pixel is defined in terms of the camera coordinate system.

The depth distance (Z) produced by each camera 12 is the perpendicular distance from the target point to the lens entrance pupil plane (the entrance pupil plane is behind the front glass of the camera). The depth distance is different from the range distance which is the straight line distance from the target point to the corresponding pixel in the lens entrance pupil plane. Note that for the target point lying on the optical axis of the camera 12, the depth and range distances are the same. The camera coordinate reference point (x=0, y=0 and z=0) is located where the optical axis intersects the lens entrance pupil plane.

The position of each target point is described by the target distance along the z axis and the angular offset along the camera x and y axis. The target point data from the multiple 3D cameras 12 is combined to create a stockpile bench face profile expressed in terms of the stockyard coordinate system.

Each camera is capable of providing target point data at a high frame rate (typically up to 30 frames per second). A high frame rate is not essential for stockpile face profiling as the reclaimer moves relatively slowly. For stockpile bench face profiling, a frame rate of 10 Hz is adequate. For a camera 12 with a pixel array size of 160×120, the number of target values returned by each camera is 192,000 per second (160×120×10 Hz).

In creating the stockpile face profile from the camera target values, it is important to:

- Preserve the accuracy of the measured face position with respect to the reclaimer bucket-wheel cutting arc.
- Store the stockpile face data in a format that facilitates accurate calculation of the bucket-wheel cut volume.
- Maintain data storage space requirements within manageable boundaries.

As the objective is to calculate the cut reclaim volume of the bucket-wheel 14, the target points from all cameras 12 are mapped into a reclaim face point map. The reclaim face point map is a two dimensional array of points coordinates. One dimension of the array extends along the length of the reclaim arc (90 degrees) whilst the second dimension wraps around the arc. The number of elements in each dimension is selected to match the available resolution of the cameras 12.

The stockpile bench face profile is stored as a height map wrapped around the bench arc. This format provides maximum resolution for rate control. The bench arc is defined as the center of the bucket-wheel 14. The bench base level and hence the arc level may vary due to any east/west slope of the stockpile base level. Distance height is stored as a UINT (unsigned int16) with a scaling factor of 0.5 mm. The bench arc length for a bench radius of 60 m is 94.75 m (π0.5*60.0). The height map wraps around the bench arc from the base to a point above bench arc. The cutting arc length for a 5.0 m radius bucket-wheel 14 is 7.85 m. A height map of 12 m is required for a profile that extends 2 m above the bench arc and 2 m behind the bench arc.

The storage requirements for a bench height map with horizontal scale of 200 mm and a vertical scale of 100 mm is 60,000 words (500×120×UINT). The height map above the bench arc level is referenced to a line running vertically up from the bench arc. The height map may be wrapped back behind the bucket-wheel base to provide for product detected behind the bucket-wheel center. The level of the height map behind the bench arc is referenced to the line running horizontally to the bench arc.

The reclaim arc is the path of the bucket-wheel center as it is slewed across the face of the stockpile. The reclaim arc center point is nominally located at the X and Y axis positions of the reclaimer reference position (slew pivot) and at the level of the bucket-wheel center point. The arc reference point is maintained at one location for the duration of a complete slew cut and then moves forward (along the X axis) in unison with the reclaimer on consecutive bench cuts. At the completion of each bench face cut, the current Reclaim Face Point Map is processed to determine the reclaimer travel target position for the next bench face cut, based on the required bucket-wheel cut depth.

Finally, the 3D volume rate control method comprises calculating a control parameter for the reclaimer 16 based on a desired reclaim volume rate 120 (see FIG. 12) compared to the cut reclaim volume rate 119. In the illustrated process this involves calculating the slew speed profile at step 122 and slew speed set point at step 124.

Preferably the reclaimer 3D volume rate control method provides both the travel target position and travel target speed in order to control the reclaim rate during the step advance motion of the reclaimer 16. The method provides reclaim rate control during the forward motion (step advance) by determination of the volume for meter (cubic meter per meter), similarly to the control strategy for slew motion.

On each occasion that the reclaimer steps forward, the current Reclaim Face Point Map is processed to create a new Reclaim Face Point Map where the bench arc pivot is located at the new reclaimer slew pivot position.

Mapping the camera target points (expressed in terms of the camera coordinates) to the stockyard area coordinate system is accomplished by rotation and translation of the target points via a camera to area Transform Matrix. The Transform Matrix is composed of a Local Transform Matrix and an Area Transform Matrix. The Local Transform Matrix provides mapping of target points from camera coordinates to reclaimer local coordinates based on the position and orientation of the camera in the local coordinate system. The Area Transform Matrix provides mapping of target points from the reclaimer local coordinates to stockyard area coordinates based on the position of each reclaimer motion.

The Local Transform Matrix for mapping the camera target points to the machine local coordinate system is calculated as follows. The position and orientation of each camera 12 in relation to the reclaimer local coordinate system is known by accurate measurement. The camera position is described by the translation of the camera coordinate reference point with respect to the reclaimer coordinate system reference point. Thus for a camera mounted 50 m from the slew pivot point, 10 m to the left of the reclaimer x axis and 15 m above the rail, the translation is x=50.0, y=−10.0 and z=15.0.

The camera orientation can be described by the direction (rotation) of the optical axis (z axis) with reference to the machine x axis and the direction (rotation) of the camera y axis with reference to the reclaimer y axis. The camera orientation is expressed as a Quaternion but can also be expressed as Euler Angles or a Rotation Matrix. The orientation quaternion and position translation are combined to provide the Local Transform Matrix.

The steps of composing the camera transform matrix, and subsequently transforming the camera image to the stockyard coordinate system is shown in FIG. 10 at steps 126 and 128. The transformed camera images are merged at step 130.

Mapping of points expressed in terms of the reclaimer local coordinates to the stockyard area coordinate system is accomplished by transformation (rotation and translation) of the points using an Area Transform Matrix. The transformation is described by the translation of the points based on the position of the reclaimer coordinate reference position within the stockyard area (x=south/north, y=east/west, z=level) and the rotation of the points based on the positions of the linked axis between the reclaimer local reference point and the point to be transformed.

The apparatus and method of reclaimer volume rate control controls the reclaim volume rate (cubic meter per second) based on the directly measured 3D stockpile bench face profile. The stockpile bench face profile is measured by the four 3D cameras 12 mounted on each side of the reclaimer bucket-wheel 14.

The individual 3D camera images are combined to provide a high resolution stockpile bench face map. The resolution of the stockpile face map depends on the camera pixel resolution and the distance from the camera to the stockpile. Typically, the stockpile face target point size is less than 40 mm in both the vertical and horizontal planes.

Parts of the bucket-wheel 14 and reclaimer boom structure 24 may encroach into the camera field of view. Image points corresponding to reclaimer structural elements are ignored when mapping the composite image to the stockpile bench face profile array. This is accomplished by provision of 3D models of the bucket-wheel 14 and boom structure 24. Target points falling within the 3D model space are ignored. Culling of the bucket-wheel image points is shown at step 132 in FIG. 10.

A profile map is created to store the stockpile bench face profile, with each profile point defined in terms of the distance from the bench arc, along a cut arc ray. The stockpile bench face profile obtained at 118 is mapped onto the buckle-wheel cut height profile to provide a bucket-wheel cut height profile at 113. The step of calculating the cut volume profile (115) of material at the stockpile bench face is performed by calculating at step 114 the sum of the volumes for each point of the stockpile bench face profile in the area abutting the bucket-wheel.

Figure 14:
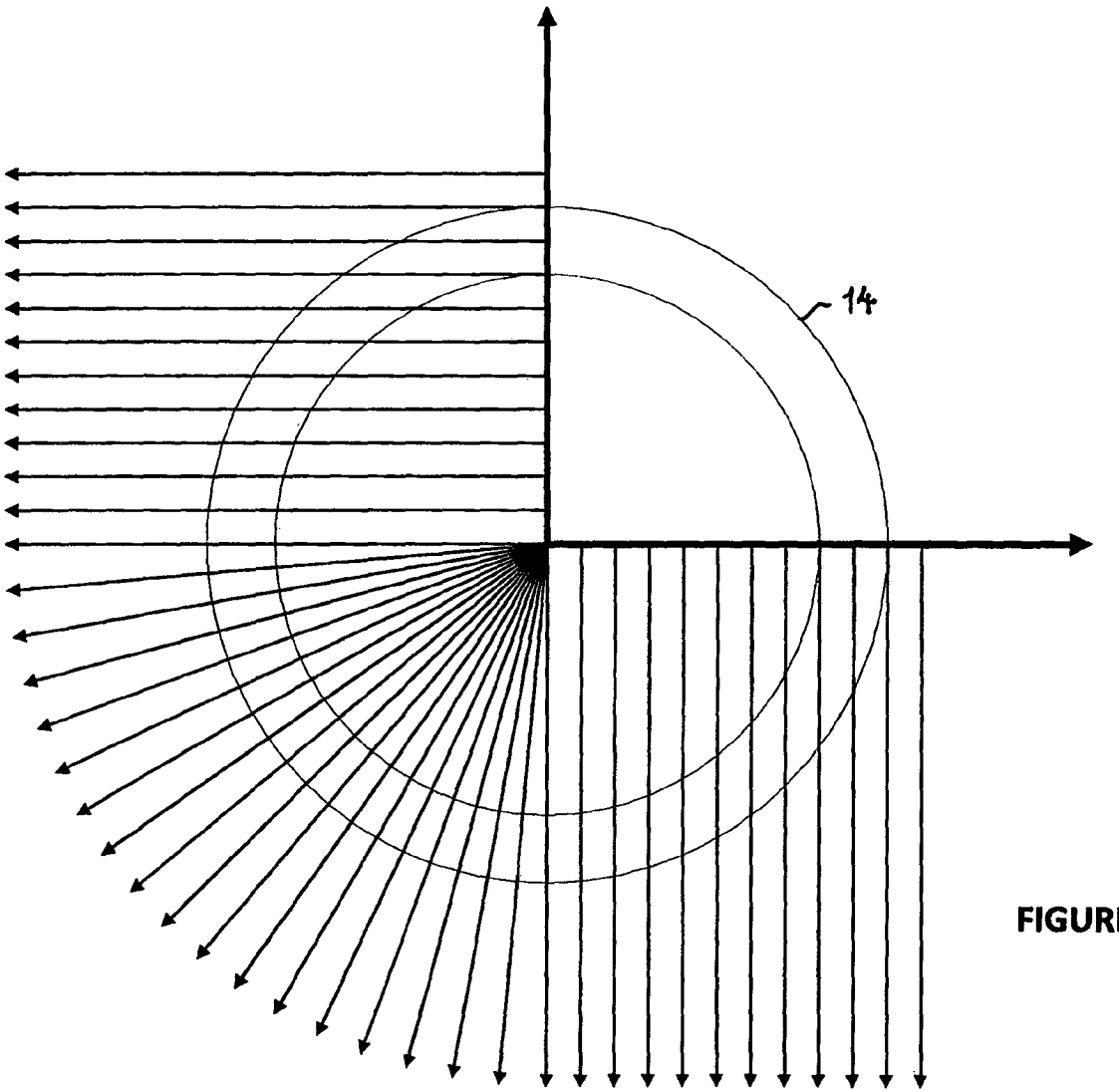

The bucket-wheel cut height profile 113 is a two dimensional array of distance values. The distance values are defined as the distance (in meter) from an arc formed by the point at the center of the bucket-wheel 14 as it is slewed outwards across the stockpile face. The distances are measured along a series of rays running perpendicular to the bucket-wheel axle. The series of rays extends from a ray pointing vertically down to a ray pointing forward to center face of the bucket-wheel 14. Where the ray extends above the center of the bucket-wheel 14, then the ray will be horizontal and the origin will lie on a line extending vertically upwards from the center of the bucket-wheel. Where the ray extends behind the center of the bucket-wheel 14, then the ray will be vertical and the origin will lie on a line extending horizontally backwards from the center of the bucket-wheel. This is illustrated in FIG. 14. The angular separation between the rays is chosen to match the camera target point size at the bucket-wheel face.

The bench cut height profile 113 is used to calculate at step 117 the bench face cut volume in the area abutting the bucket-wheel excavation tool. The reclaim cut volume rate 119 is then calculated at step 123 as the change in volume of the stockpile bench face between two points in time. The time interval between volume sampling is chosen to provide continuous update of the reclaim volume rate 119.

The bench cut height profile 113 is also used to calculate at step 114 the cut volume profile (115 in FIG. 11), as the bucket-wheel cut volume per meter of bench arc length at intervals along the bench arc. This is based on the known cut radius of the bucket-wheel. The cut volume profile 115 is used to calculate, at step 121 in FIG. 12, a feed forward reclaim volume rate profile. A control parameter for the reclaimer is then calculated at step 125 based on a desired reclaim volume rate compared to the measured cut reclaim volume rate and the feed forward volume rate profile.

The bucket-wheel cut volume per meter (cut volume profile 115) is also used to calculate, at step 122 (in FIG. 12), the bucket-wheel slew speed profile at all points along the bench arc. The calculated bucket-wheel slew speed profile is published to the slew speed control system in machine controller 22.

Due to compaction, the bulk density of stacked material will be higher than the reclaimed material bulk density. Fines material has a higher compaction factor than lump material. Material excavated by the bucket-wheel 14 will be made up of a mixture of compacted and loose material. The mix depends on the product flow characteristics and the presence of collapsed material. Compensation for the change in bulk density may be provided by a 'Material Volume Compensation' factor which is defined as the ratio of the 'Reclaimed Material Volume' to the 'Stacked Material Volume'. This factor may be provided by a lookup table which contains a factor for each material type, or optionally by measurement of the reclaimed volume and subsequent calculation of the 'Material Volume Compensation' for the current stockpile product.

Calculation of the 'Material Volume Compensation' is achieved by a software routine which tracks the 'Stacked Material Volume' from the bucket-wheel to a position on the reclaimer boom conveyor where the 'Reclaimed Material Volume' is measured. Measurement of the 'Reclaimed Material Volume' is typically provided by a belt profile scanner, using a 2D laser line scanner or a 3D image capture instrument.

It is normally necessary to ensure that the bucket-wheel power (or torque) is maintained within the drive operating power limits. The reclaim rate is limited in high power scenarios to control both the instantaneous peak power and longer term thermal power limits of the bucket-wheel drive. This is accomplished in step 124 (see FIG. 12) by limiting the slew speed if the bucket-wheel power exceeds predefined limits.

The 3D volume rate control apparatus and method preferably also provides both the travel target position and travel target speed in order to control the reclaim rate during the step advance motion. The apparatus and method provide reclaim rate control during the forward motion (step advance) by determination of the volume for meter (cubic meter per meter), similarly to the control strategy for slew motion.

Now that preferred embodiments of the 3D volume rate control method and apparatus have been described in detail, it will be apparent that the described embodiments provide a number of advantages over the prior art, including the following:

(i) Providing accurate reclaim volume measurement the reclaim volume rate becomes independent of the product characteristics, stockpile face shape and bucket-wheel cutting characteristics.

(ii) Whilst measurement and calculation of the reclaim volume is complex, the application of the bucket-wheel speed control is simplified as there is no longer any requirement to apply the customised correction parameters that are typically required to improve performance of power based controllers.

(iii) Providing machine collision protection by detecting when the end target of a bench lies below the face of the next higher bench to avoid undermining; detecting stockpile face collapse; and, continuously monitoring the space on each side of the boom and stopping the machine motion to avoid stockpile and machine collisions.

(iv) Providing improved reclaim production rates: by using the highly accurate 3D bucket-wheel to stockpile distance to provide automatic bench face up control with optimum cut depth on the first slew; by using the accurate edge detection and optimised cut depth at all stockpile positions, including complete compensation for the end cone shape to produce optimum cut depth every time; by optimising slew turn around based on the correct determination of the face edge position; by maintaining accurate volume based slew speed control throughout the entire bench arc to optimise the slew turn around; by avoiding the reclaim conditions that lead to stockpile creep based on accurate edge detection; by maintaining the cut depth at the optimum values independent of the inner slew turnaround position, end cone shape and bench height and thus reclaiming with the minimum number of slew cuts; by removing the dependence on product characteristics (density, moisture content etc. . . . ) to achieve maximum route volume rate; by providing measured rate control in both cutting directions and therefore not being affected by changes in bucket-wheel cutting efficiency caused by the tilt and skew in relation to the bench face; and, by using the scanned bench face profile to detect face collapses the controller is able to respond to the collapse and avoid bucket-wheel overload, and the collapsed volume is measured so the production rate is maintained.

(v) Providing reduced maintenance and improved production without driving the machine harder. The tighter reclaim control provides several maintenance benefits, including reduced bucket-wheel wear (optimised bucket-wheel cut depth), improved belt tracking (less fluctuation in reclaim rate), and reduced chute blockages (peak volume rate controlled).

It will be readily apparent to persons skilled in the relevant arts that various modifications and improvements may be made to the foregoing embodiments, in addition to those already described, without departing from the basic inventive concepts of the present invention. For example, other suitable types of 3D image sensors may be employed apart from the time-of-flight 3D cameras described. Therefore, it will be appreciated that the scope of the invention is not limited to the specific embodiments described.

The invention claimed is:

1. A three-dimensional (3D) volume rate control apparatus for a stockpile reclaimer, the apparatus comprising:

a plurality of 3D image sensors mounted adjacent to an excavation tool of the stockpile reclaimer and that provide 3D images of a stockpile bench face; and, a data processor that:

processes the 3D images provided by the 3D image sensors to generate a 3D stockpile bench face profile, calculates a reclaim cut volume rate at which material is being cut from the stockpile bench face based on a measured change in volume of the 3D stockpile bench face profile in an area abutting the excavation tool, calculates a reclaim cut volume of material that will be cut from the stockpile bench face based on a shape of the excavation tool and the 3D stockpile bench face profile to determine a feed forward reclaim cut volume rate profile, and calculates an operating parameter for the stockpile reclaimer based on a desired reclaim cut volume rate compared to the calculated reclaim cut volume rate and the feed forward reclaim cut volume rate profile;

a machine controller that is connected to the data processor and the excavation tool and that controls a motion pathway of the excavation tool by controlling at least one of: a travel speed of the excavation tool or a slew speed of the excavation tool.

2. A 3D volume rate control apparatus as defined in claim 1, wherein respective 3D image sensors are mounted on each side and adjacent to the excavation tool to provide 3D images of a complete cutting arc of the excavation tool on the stockpile bench face.

3. A 3D volume rate control apparatus as defined in claim 2, wherein the 3D image sensors provide 3D images extending along a swing arc of the complete cutting arc for a distance to cover areas of the stockpile bench face that may flow or collapse around the excavation tool.

4. A 3D volume rate control apparatus as defined in claim 2, wherein two of the 3D image sensor are located on each side of the excavation tool respectively.

5. A 3D volume rate control apparatus as defined in claim 1, wherein the 3D image sensors are 3D time-of-flight cameras which measure a distance to an object in front of the cameras by analysing the time for a light pulse to travel from an illumination source to the object and back.

6. A 3D volume rate control apparatus as defined in claim 1, wherein the stockpile reclaimer is a bucket-wheel reclaimer and the excavation tool is a bucket-wheel.

7. A 3D volume rate control apparatus as defined in claim 6, wherein the bucket-wheel reclaimer is a slewing bucket-wheel reclaimer.

8. A method of three-dimensional (3D) volume rate control for a stockpile reclaimer, the method comprising:

obtaining 3D images of a stockpile bench face;

processing the 3D images to generate a 3D stockpile bench face profile;

calculating a reclaim cut volume rate based on a measured change in volume of the 3D stockpile bench face profile in an area abutting an excavation tool of the stockpile reclaimer;

calculating a reclaim cut volume of material that will be cut from the stockpile bench face based on a shape of the excavation tool and the 3D stockpile bench face profile to determine a feed forward cut volume rate profile;

calculating an operating parameter for the stockpile reclaimer based on a desired reclaim cut volume rate compared to the calculated reclaim cut volume rate and the feed forward reclaim cut volume rate profile;

sending the operating parameter to a machine controller connected to the excavation tool, and controlling, based on the operating parameter, at least one of: a travel speed of the excavation tool, or a slew speed of the excavation tool.

9. A method of 3D volume rate control as defined in claim 8, wherein calculating the reclaim cut volume of material is performed by producing an excavation tool cut height map, wherein the excavation tool cut height map is a two dimensional array of distance values measured from a reference on the excavation tool to an edge of the excavation tool where it cuts into the stockpile bench face.

10. A method of 3D volume rate control as defined in claim 9, wherein the stockpile reclaimer is a bucket-wheel reclaimer, the excavation tool is a bucket-wheel, and the excavation tool cut height map is a bucket-wheel cut height map.

11. A method of 3D volume rate control as defined in claim 10, wherein the bucket-wheel reclaimer is a slewing bucket-wheel reclaimer.

12. A method of 3D volume rate control as defined in claim 11, wherein the reference on the excavation tool is a bench arc formed by a point at the center of the bucket-wheel as it is slewed outwards across the stockpile bench face.

13. A method of 3D volume rate control as defined in claim 12, wherein the distance values are the distance from the bench arc measured along a series of cut arc rays running perpendicular to a bucket-wheel axle.

14. A method of 3D volume rate control as defined in claim 13, wherein the series of cut arc rays extend from a ray pointing vertically down to a ray pointing towards center face of the bucket-wheel.

15. A method of 3D volume rate control as defined in claim 14, wherein an angular separation between the rays matches a sensor target point size at the center face of the bucket-wheel.

16. A method of 3D volume rate control as defined in claim 10, wherein calculating a reclaim cut volume rate comprises calculating a volume of material at the stockpile bench face.

17. A method of 3D volume rate control as defined in claim 16, wherein calculating a reclaim cut volume of material at the stockpile bench face comprises calculating a sum of the volumes for each point of the 3D stockpile bench face profile in an area abutting the bucket-wheel.

18. A method of 3D volume rate control as defined in claim 10, wherein calculating the reclaim cut volume rate comprises comparing a stockpile bench face volume at two points in time as the bucket-wheel cuts the stockpile bench face.

19. A method of 3D volume rate control as defined in claim 15, further comprising creating a profile map and storing the 3D stockpile bench face profile in the profile map, the 3D stockpile bench face profile includes a plurality of profile points, and each profile point is defined by a distance from the bench arc along a cut arc ray.

20. A method of 3D volume rate control as defined in claim 19, further comprising calculating a bucket-wheel face height map from the 3D stockpile bench face profile.

21. A method of 3D volume rate control as defined in claim 20, further comprising calculating a bucket-wheel cut volume per meter of bench arc length at intervals along a bench arc of the stockpile bench face based on a known cut radius of the bucket-wheel and the bucket wheel face height map.

22. A method of 3D volume rate control as defined in claim 21, further comprising calculating a bucket-wheel slew speed at all points along the bench arc of the stockpile bench face based on the reclaim cut volume rate, the bucket wheel cut volume per meter and a desired reclaim volume rate.

23. A method of 3D volume rate control as defined in claim 22, wherein the bucket-wheel slew speed is published to a reclaimer slew speed control system.

* * * * *